US009720376B2

(12) United States Patent
Tsushima

(10) Patent No.: US 9,720,376 B2
(45) Date of Patent: Aug. 1, 2017

(54) BAND TYPE ELECTRONIC DEVICE AND SUBSTRATE ARRANGEMENT METHOD

(71) Applicant: Sony Corporation, Tokyo (JP)

(72) Inventor: Teppei Tsushima, Tokyo (JP)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 0 days.

(21) Appl. No.: 14/817,960

(22) Filed: Aug. 4, 2015

(65) Prior Publication Data

US 2016/0139564 A1 May 19, 2016

Related U.S. Application Data

(60) Provisional application No. 62/081,157, filed on Nov. 18, 2014.

(51) Int. Cl.

| | |
|---|---|
| ***G04G 17/06*** | (2006.01) |
| ***G04B 37/14*** | (2006.01) |
| ***G04R 60/04*** | (2013.01) |
| ***A44C 5/00*** | (2006.01) |
| *A44C 5/02* | (2006.01) |

(52) U.S. Cl.

CPC ..... *G04B 37/1486* (2013.01); *A44C 5/003* (2013.01); *G04G 17/06* (2013.01); *G04R 60/04* (2013.01); *A44C 5/02* (2013.01)

(58) Field of Classification Search

CPC ..... G04B 5/16; G04B 31/08; G04B 37/1486; G04C 10/00; G04G 17/06; A44C 5/003; A44C 5/02; G04R 60/04

USPC ..... 368/148, 282

See application file for complete search history.

(56) References Cited

U.S. PATENT DOCUMENTS

| | | | | |
|---|---|---|---|---|
| 4,255,801 | A * | 3/1981 | Ode | A44C 5/14 368/10 |
| 4,412,751 | A | 11/1983 | Jeannet et al. | |
| 5,491,651 | A | 2/1996 | Janik | |
| 5,581,492 | A | 12/1996 | Janik | |
| 5,615,179 | A | 3/1997 | Yamamoto et al. | |

(Continued)

FOREIGN PATENT DOCUMENTS

| | | | |
|---|---|---|---|
| EP | 0 660 204 | A1 | 6/1995 |
| EP | 1 177 736 | A2 | 2/2002 |

(Continued)

OTHER PUBLICATIONS

Translation of JP 02017696; Mar. 2016.*

Extended Search Report issued Feb. 22, 2016 in European patent Application No. 15189974.7.

*Primary Examiner* — Sean Kayes

(74) *Attorney, Agent, or Firm* — Oblon, McClelland, Maier & Neustadt, L.L.P.

(57) ABSTRACT

A band-type electronic device and a method for configuration of a flexible circuit board in a band-type electronic device are disclosed. The band-type electronic device includes a plurality of segments connected with each other in a band-like shape, a plurality of electronic components arranged in the plurality of segments, and a flexible circuit board connected to the plurality of electronic components arranged in the plurality of segments, wherein the flexible circuit board is partly deformed into a meandering shape in at least one of the plurality of segments.

17 Claims, 8 Drawing Sheets

(56) References Cited

U.S. PATENT DOCUMENTS

| | | | | |
|---|---|---|---|---|
| 5,798,907 | A | 8/1998 | Janik | |
| 6,108,197 | A | 8/2000 | Janik | |
| 6,120,177 | A * | 9/2000 | Hara | G04B 5/16 368/149 |
| 6,619,835 | B2 * | 9/2003 | Kita | A44C 5/0015 368/10 |
| 6,619,836 | B1 * | 9/2003 | Silvant | G04G 17/08 368/281 |
| 7,618,260 | B2 * | 11/2009 | Daniel | A44C 5/0007 24/311 |
| 8,301,211 | B2 * | 10/2012 | Lee | H04M 1/274525 340/539.11 |
| 8,467,270 | B2 * | 6/2013 | Gossweiler, III | G04G 17/06 345/173 |
| 8,686,908 | B2 * | 4/2014 | Kusunoki | 343/702 |
| 2002/0012292 | A1 | 1/2002 | Mitamura | |
| 2003/0103414 | A1 * | 6/2003 | Lyon | G04G 17/083 368/10 |
| 2008/0037374 | A1 * | 2/2008 | Chu | G04G 9/02 368/82 |
| 2008/0106980 | A1 * | 5/2008 | Guillaume | G04B 37/1486 368/282 |
| 2008/0248838 | A1 * | 10/2008 | Chiang | G04G 21/04 455/566 |
| 2009/0135681 | A1 * | 5/2009 | Lawson | A44C 5/00 368/282 |
| 2009/0207701 | A1 * | 8/2009 | Jacques | G04G 17/083 368/205 |
| 2014/0275852 | A1 * | 9/2014 | Hong | A61B 5/02427 600/301 |
| 2015/0124567 | A1 * | 5/2015 | Liao | G04G 17/06 368/10 |
| 2015/0342480 | A1 * | 12/2015 | Justice | A61B 5/7225 600/479 |

FOREIGN PATENT DOCUMENTS

| | | |
|---|---|---|
| EP | 1 177 736 A3 | 2/2002 |
| JP | 57-86492 | 5/1982 |
| JP | 2-17696 U | 2/1990 |
| JP | 2007-14471 | 1/2007 |
| WO | WO 95/21408 A1 | 8/1995 |

* cited by examiner

BAND TYPE ELECTRONIC DEVICE AND SUBSTRATE ARRANGEMENT METHOD

CROSS REFERENCE TO RELATED APPLICATIONS

This application claims the benefit of priority from U.S. Provisional Application No. 62/081,157, filed on Nov. 18, 2014, the contents of which are incorporated herein by reference in entirety.

BACKGROUND

Field of the Disclosure

This application relates generally to a band type electronic device installed in a band which accompanies a wristwatch, and the substrate arrangement method applied to the band type electronic device.

Description of the Related Art

In recent years, an electronic device of a wristwatch such as a smart watch has evolved significantly to perform several functions. A smart watch can be used similarly to a wristwatch, worn on a user's wrist. The smart watch displays information about messages, such as reception of a telephone or an email. The smart watch display is built into the surface of the main-body part of the electronic device, and various types of information are shown on a display.

Usually, the smart watch can perform near field communication, such as BLUETOOTH with a radio telephone terminal (smart phone), and can transmit information to and from the radio telephone terminal.

Conventional wristwatch which shows only time and a history log may be provided as accessories. A conventional wristwatch comes in various designs while performing the same function. Implementing an electronic device in a conventional wristwatch to function as a smart watch can be challenging and has several limitations including interference from the metal casing. Further there are size limitations for implementing the smart watch electronic circuitry in a conventional watch. Further waterproofing of the electronic device can be a major challenge.

There remains a continuing need to provide improved functionality, strength and performance of conventional watches.

SUMMARY

According to an embodiment of the present disclosure, there is provided a band-type electronic device. The band-type electronic device includes a plurality of segments connected with each other in a band-like shape, a plurality of electronic components arranged in the plurality of segments, and a flexible circuit board connected to the plurality of electronic components arranged in the plurality of segments, wherein the flexible circuit board is partly deformed into a meandering shape in at least one of the plurality of segments.

Further, according to an embodiment of the present disclosure, there is provided a method for configuration of a flexible circuit board in a band-type electronic device, the method includes arranging a flexible circuit board in a plurality of segments connected to each other in a band-like shape, attaching a plurality of electronic components to the flexible circuitry, and deforming the flexible circuit board into a meandering shape in at least one of the plurality of segments.

The forgoing general description of the illustrative implementations and the following detailed description thereof are merely exemplary aspects of the teachings of this disclosure, and are not restrictive.

BRIEF DESCRIPTION OF THE DRAWINGS

A more complete appreciation of the disclosed embodiments and many of the attendant advantages thereof will be readily obtained as the same becomes better understood by reference to the following detailed description when considered in connection with the accompanying drawings, wherein.

DETAILED DESCRIPTION

Figure 1:
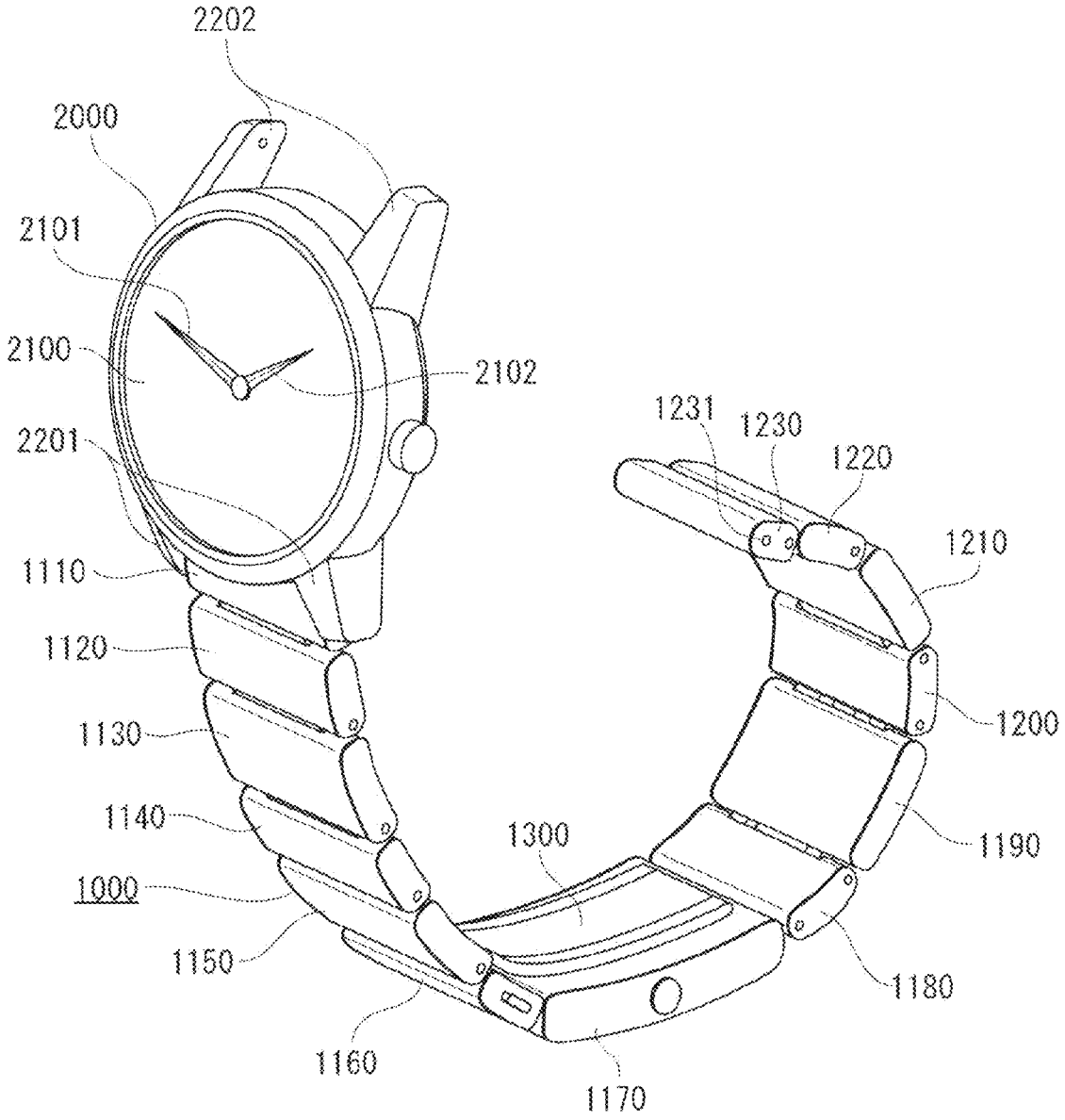
FIG. 1 is an exemplary structure of a band type electronic device according to an exemplary embodiment of the present disclosure.

In the drawings, like reference numerals designate identical or corresponding parts throughout the several views. Further, as used herein, the words "a", "an" and the like generally carry a meaning of "one or more", unless stated otherwise. The drawings are generally drawn to scale unless specified otherwise or illustrating schematic structures or flowcharts.

Furthermore, the terms "approximately," "proximate," "minor," and similar terms generally refer to ranges that include the identified value within a margin of 20%, 10% or preferably 5% in certain embodiments, and any values therebetween.

In the drawings or figures, the terms "top", "bottom", and similar terms are based on a viewing perspective of the figure such that the captions are located approximately at the center and below a drawing. The term "top" refers to the part of the figure on the top side of the drawing with the caption (e.g., "FIG. 1") located at the bottom of the figure. The term "bottom" refers to the part of the figure on the bottom side of the drawing with the caption located at the bottom of the figure.

A band type electronic device of the present disclosure is an attachment to a conventional wristwatch to enhance the functional capability of a conventional watch. The electronic device in a band (belt) is a stand-alone application. The design and development of a band-type electronic device can pose several challenges. For example, a wiring of a circuit board in a flexible manner, waterproofing the structure, overcoming the interference from the metal casing, and maintaining electrical contact when the band-type electronic device is installed in an extendible band such as a band with a buckle which can extend in an unlocked state and collapse in a locked state.

In one embodiment, a structure is discusses that can accommodate a flexible wiring system with waterproofing members. When a flexible member is bent or extended stresses may be developed which can break the flexible member. In one embodiment a structure is provided to prevent any accidental tear of the flexible member.

In another embodiment, a metal band is modified to avoid electromagnetic interference due to the metal during a communication via an antenna. These modifications ensure uninterrupted communication with different devices. Furthermore additional care is taken to prevent skin contacted with the antenna, as it may deteriorate the antenna characteristics.

FIG. 1 shows an exemplary structure of a band type electronic device according to an embodiment of the present disclosure. The band type electronic device 1000 is a metal band attached to a timepiece body 2000, and that can be worn on a user's arm. The timepiece body 2000 is equipped with a dial face 2100 and pointers 2101 and 2102, which rotate on the dial face 2100 to indicate time. In another embodiment, the timepiece body 2000 may show time electronically with a liquid crystal display etc. The timepiece body 2000 is also equipped with band mounting holes 2201 and 2202 on the outer side of the timepiece body 2000 at the lower end and the upper end respectively.

The band type electronic device 1000 includes several segments 1110-1230, a pin 1231, and a buckle part 1300. The band type electronic device 1000 is formed by connecting several segments 1110-1230 in a sequence. The segment 1110 is attached to the band mounting hole 2201 on the lower end of the timepiece body 2000, and the segment 1230 is attached to the band mounting hole 2202 above the timepiece body 2000. The connection between the segment 1230 and the band mounting hole 2202 is established by inserting the pin 1231. Similarly, the segment 1110 and the band mounting hole 2201 are connected via a pin (not shown). In the present disclosure each of the segments 1110-1230 is comprised of a metal. The connection made by the segments 1110 and 1230 to the timepiece body 2000 creates a loop which allows the timepiece body 2000 to be worn on a user's arm similar to a conventional wristwatch. Further, depending on the size of the wrist of a user additional segments may be added to the band type electronic device 1000 or a different segment may be used to connect the band type electronic device 1000 to the timepiece body 2000. Thus the band type electronic device 1000 can be made to fit a user's arm by the ability to move the connection place of a segment.

The buckle part 1300 is arranged on the segment 1170, which is placed between the segment 1180 and the segment 1160. The buckle part 1300 includes a locking mechanism. When the buckle part 1300 is in an unlocked state, the buckle part 1300 can be extended such that segments 1180 and 1160 move further apart. In the locked state, the buckle part 1300 has a shorter length and the segments 1160 and 1180 are placed closer to each other. The details of the buckle part 1300 are discussed later in the present disclosure.

Each of the segments 1110-1230 can be of different size, shape or material. For example, the segment 1170 connected with the buckle part 1300 has the largest size. A specific example discussing the size of each segment segments 1110-1230 is mentioned later in the disclosure.

Figure 2:
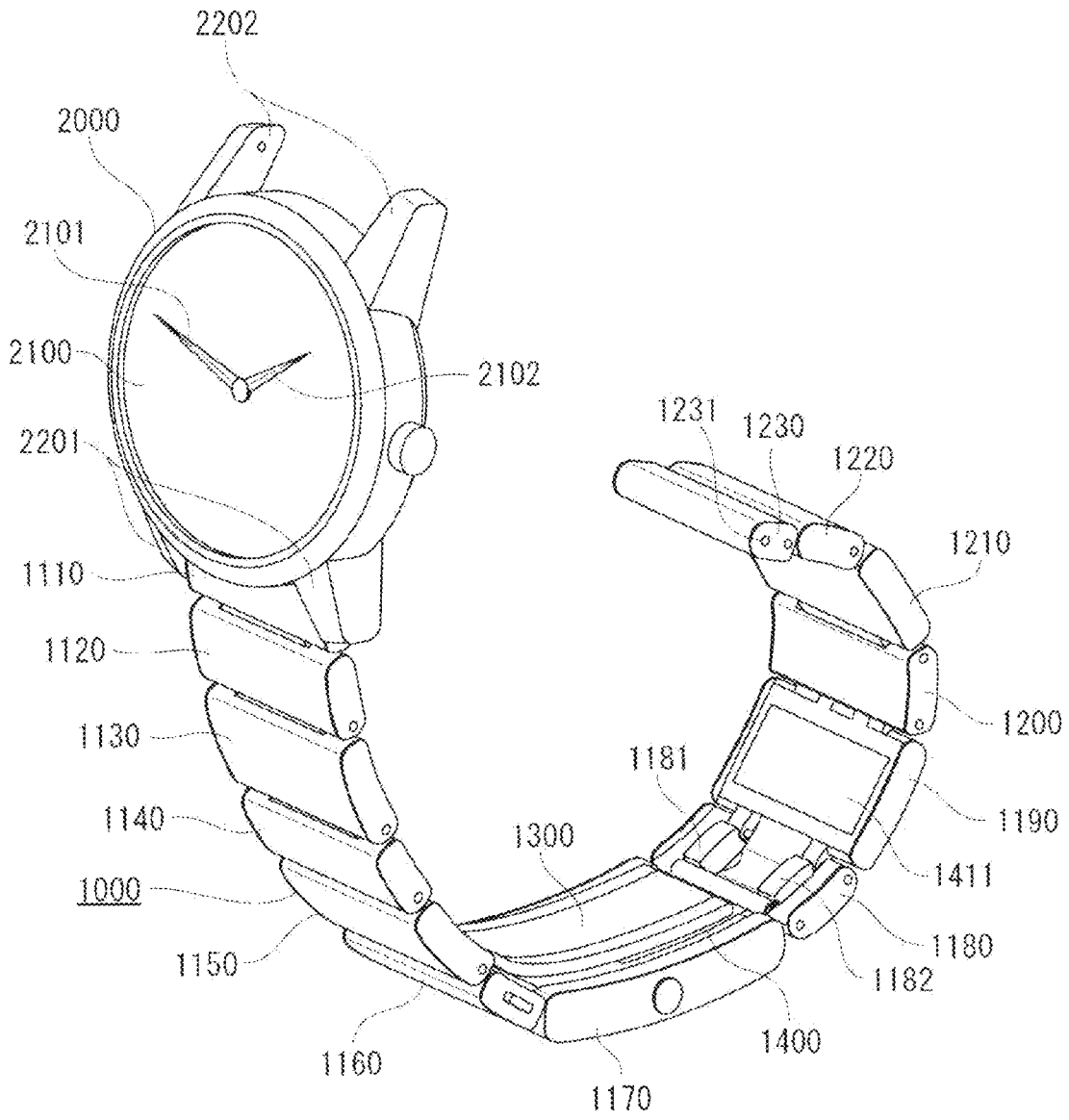
FIG. 2 illustrates a part of internal structure of the band type electronic device according to an exemplary embodiment of the present disclosure.

FIG. 2 illustrates a part of internal structure of the band type electronic device 1000 according to an embodiment of the present disclosure. FIG. 2 illustrates the internal details of three segments 1170, 1180, and 1190. The band type electronic device 1000 according to an embodiment of the present disclosure arranges a flexible circuit board 1400 inside five continuous segments 1170-1210.

Various electronic components are arranged in the segment 1170, and a battery 1411 is arranged in the segment 1190. The circuit components are electrically connected by a flexible member. The segment 1180, placed between the segment 1170 and the segment 1190, is comparatively smaller in size. Inside the segment 1180, a part of the flexible circuit board 1400 is placed inside waterproof members 1181 and 1182. Inside the segments 1170-1210 a waterproof structure for placing the parts of the flexible circuit board 1400 is provided. The details of the waterproof structure of segments 1170-1210 is discussed later in the disclosure.

It should be noted that in FIG. 1 and FIG. 2, the timepiece body 2000 and the segment 1230 are shown in a separated state in order to explain the structure of the band type electronic device 1000. However, the segment 1230 is attached to the timepiece body 2000 during actual usage.

Figure 3:
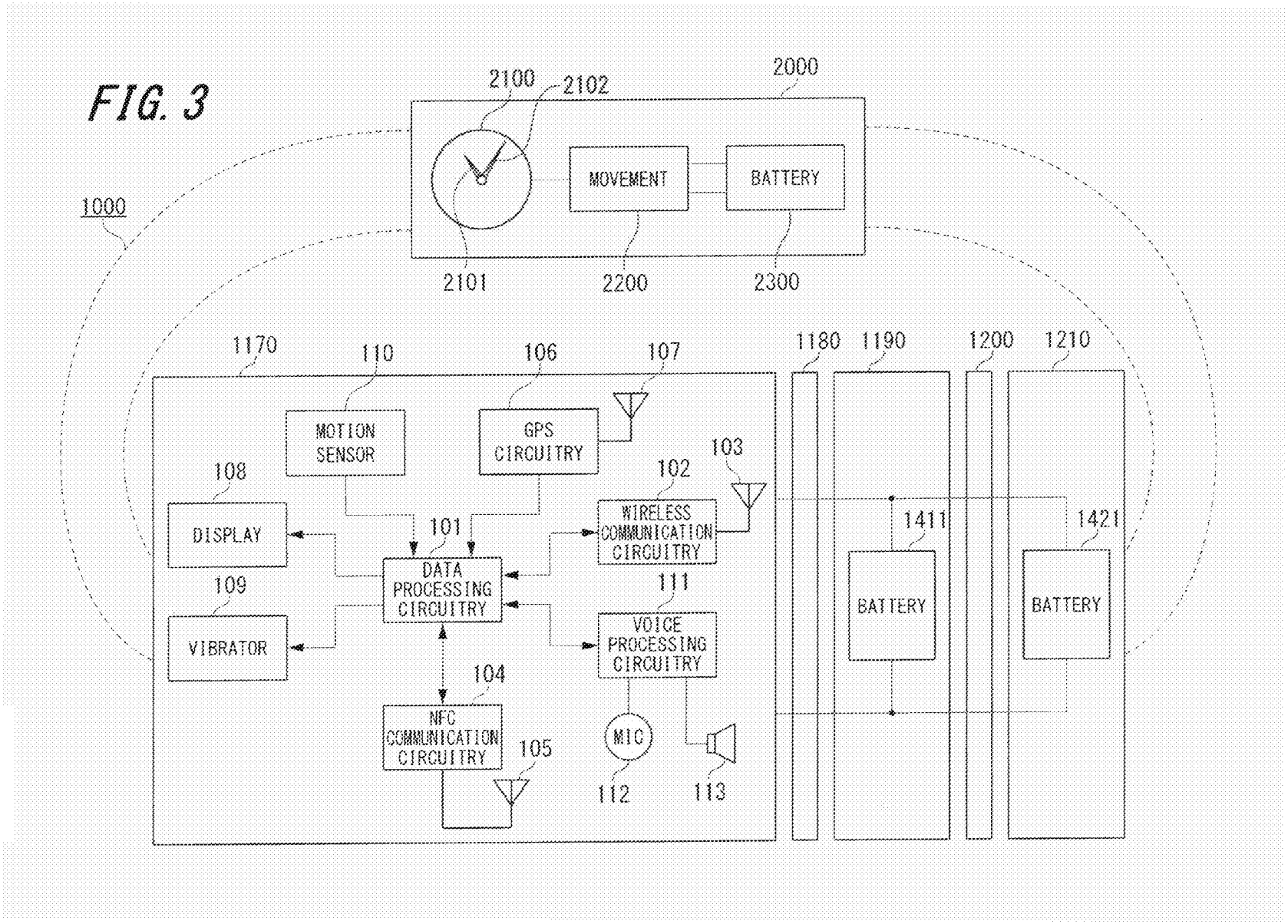
FIG. 3 is a block diagram illustrating the circuit structure of the band type electronic device according to an exemplary embodiment of the present disclosure.

FIG. 3 is a block diagram of the circuit structure included in the band type electronic device 1000. The circuit inside the band type electronic device 1000 is independent of the circuit inside the timepiece body 2000. The timepiece body 2000 is equipped with the movement mechanism 2200 which rotates the pointers 2101 and 2102 arranged at the dial face dial face 2100. Within the timepiece body, a battery 2300 can be connected to a movement mechanism 2200. The movement mechanism 2200 and the battery 2300 can be incorporated inside a casing of the timepiece body 2000. On the other hand, the band type electronic device 1000 connected to the timepiece body 2000 includes several electronic components arranged in three different segments 1170, 1190, 1210.

The segment 1170 includes a data processing circuitry 101, a wireless communication circuitry 102, an antenna 103, a NFC (Near Field Communication) communication circuitry 104, an antenna 105, a GPS circuitry 106, an antenna 107, a display 108, a vibrator 109, a motion sensor 110, a voice processing circuitry 111, a microphone 112, and a speaker 113.

The data processing circuitry 101, the wireless communication circuitry 102, the NFC communication circuitry 104, and the GPS circuitry 106 are arranged inside the segment 1170. The antennas 103, 105 and 107 are connected to the wireless communication circuitry 102, the NFC communication circuitry 104, and the GPS circuitry 106, respectively. Each of the antennas 103, 105 and 107 is arranged in the vicinity of a slit 1173 (shown in FIG. 4) of a segment 1170.

The wireless communication circuitry 102 performs terminal and near field communication, for example according to the specification of BLUETOOTH. The NFC communication circuitry 104 is based on the specification of NFC. The NFC communication circuitry 104 performs a read/write function with the adjoining wireless communications. The GPS circuitry 106 is a positioning circuitry which receives the electromagnetic wave from the satellite of the system called GPS (Global Positioning System), and performs the positioning of present position. The data obtained from the wireless communication circuitry 102, the NEC communication circuitry 104, and the GPS circuitry 106 are supplied to the 101.

Moreover, the display 108, the vibrator 109, the motion sensor 110, and the voice processing circuitry 111 can be arranged inside the segment 1170. The display 108 comprises light emitting diodes that can notify a user by turning a light on and off or by blinking. Several light emitting diodes can be arranged within the segment 1170, for example inside the slit 1173 (shown in FIG. 4) of a segment 1170. The notification can be of different types such as a reception of a telephone, a reception of an email, etc. can be notified by turning a light on and off or by blinking.

The display 108 may be used to display information such as a character, a number, etc. The information may be associated with different aspects such as a name, temperature, etc. The vibrator 109 can be used to vibrate the segment 1170. Using the vibrator 109, the band type electronic device electronic device 1000 can notify a reception of a telephone, a reception of an email, etc. via vibration signal generated by vibrator 109 in the segment 1170.

The motion sensor 110 detects a motion of the user equipped with the band type electronic device 1000. The motion sensor 110 can be an acceleration sensor, a gyro sensor, an electronic compass, an atmospheric-pressure sensor etc. Moreover, the segment 1170 may incorporate sensors other than the motion sensor 110. For example, a biosensor which detects the pulse of the user equipped with the band type electronic device electronic device 1000, etc. may be incorporated.

The microphone 112 and the speaker 113 are connected to the voice processing circuitry 111. The voice processing circuitry 111 can process a telephone call with the other party connected by wireless communications via the wireless communication circuitry 102. Furthermore, the voice processing circuitry 111 may also perform the process for voice input operation.

The segments 1190 and 1210 incorporate the batteries 1411 and 1421 respectively. The batteries 1141 and 1142 can be of different types such as a lithium ion battery, a button cell etc. The batteries 1141 and 1142 act as a power source for the circuit in the segment 1170. The circuit in a segment 1170, the battery 1411 in the segment 1190 and the battery 1421 in the segment 1210 are connected by the flexible circuit board 1400 (shown in FIG. 4). Furthermore, the segment 1170 can be equipped with the charging terminal (not shown) for charging a battery such as batteries) 141 and 1142.

The arrangement of the electronic components of the band type electronic device 1000 is not limited to above discussion. Some of the electronic components other than batteries 1141 and 1142 may be arranged in the segments 1190 and 1210. Further additional electronic components may be included. For example, the segments 1190 and 1210 may be equipped with a charging circuit (not shown) which controls charging and discharging of the batteries 1141 and 1142.

Figure 4:
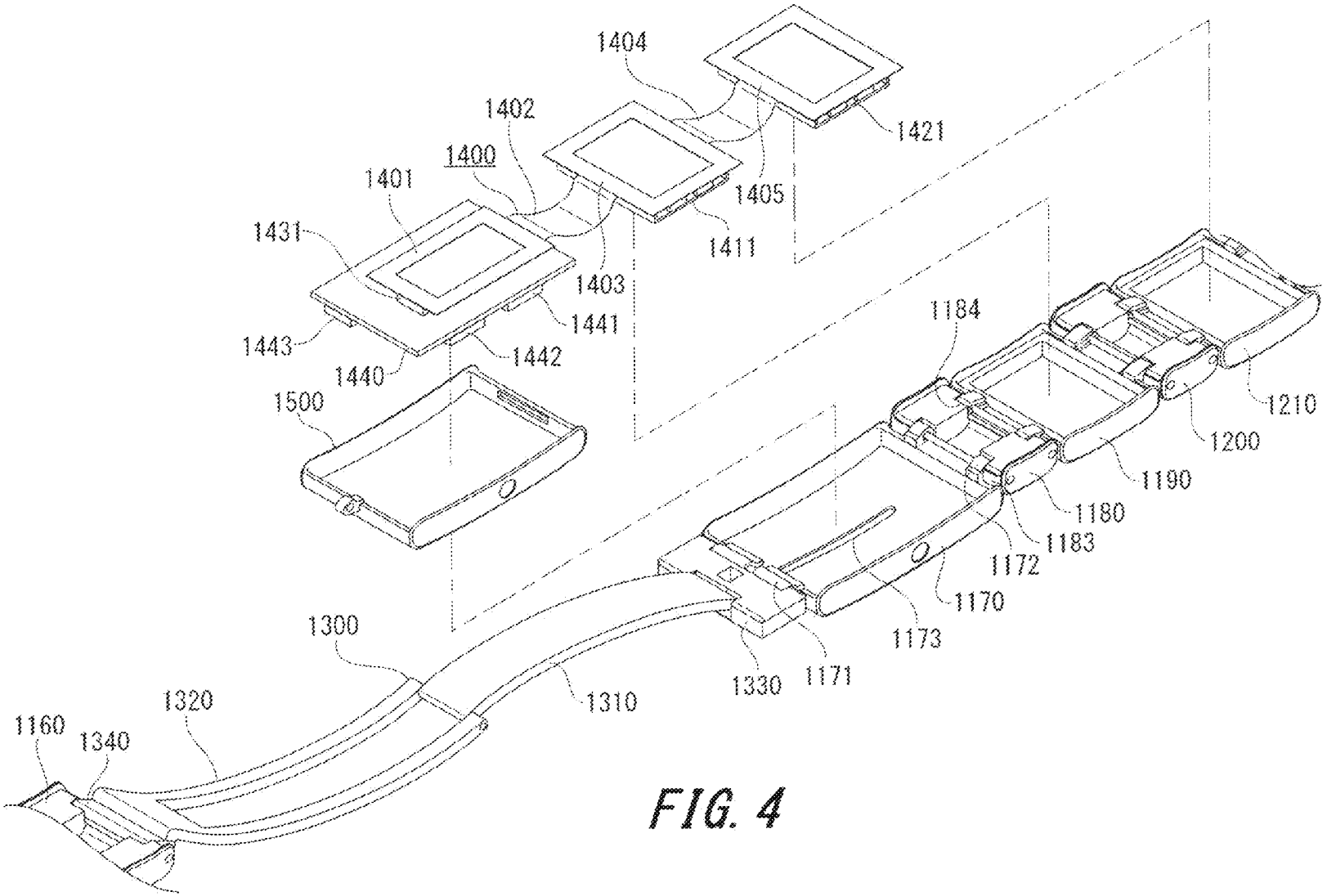
FIG. 4 shows the internal structure of the segments of the band type electronic device and the connection between different segments according to an exemplary embodiment of the present disclosure.

FIG. 4 shows the internal structure of the segments 1170-1210 and the connection between different segments. Inside the segments 1170-1210, the flexible circuit board 1400 and the electronic component discussed with reference to FIG. 3 are arranged. To identify the location of the electronic component clearly, the buckle part 1300 is shown in an unlocked state.

The buckle part 1300 includes a first member 1310 and a second member 1320 of the buckle part 1300. In the locked state the first member 1310 and second member 1320 are folded in an overlapping manner and placed above the segment 1170. The segment 1170 includes a connector 1171 which is connected to a connecting member 1330, thus establishing the flexible connection between the segment 1170 and the buckle part 1300. The other side of the segment 1170 includes a connector 1172 which is connected with the connector 1183 of a segment 1180. Further, the segment 1180 includes a connecting member 1184 which is connected with a segment 1190. Similarly, the segment 1200 is connected to the segment 1190, and the segment 1210 is connected to a segment 1200. Each connection part connects two segments using a coupling pin (not shown).

The segment 1170 is larger than other segments, which allows assembly of several electronic components shown in FIG. 3 in a compact manner inside the segment 1170. Inside the segment 1170, an inner casing 1500 made from transparent resin (or translucent resin) is arranged. The flexible circuit board 1400 and other electronic components discussed in FIG. 3 are arranged within the inner casing 1500. Further within the inner casing 1500, the display 108 in FIG. 3 is arranged such that the light emitting diodes are adjacent to the slit 1173. The slit 1173 is formed in the surface of a segment 1170 through which the light emission and blinking of the light emitting diodes can be seen. Moreover, each of the antennas 103,105 and 107 are arranged in the inner casing 1500 close to the slit 1173. Thus, each of the antennas 103,105 and 107 can be arranged such that interference due to metal can be avoided and a favorable communication state with the outer side of the metal segments 1170 can be maintained.

The flexible circuit board 1400 is divided into five components 1401-1405 and each of the five components is distributed among the segments 1170-1210. The first sub-component 1401 of the flexible circuit board 1400 is arranged within the inner casing 1500 of a segment 1170. Further, the first sub-component 1401 of the flexible circuit board 1400 is connected to a rigid substrate 1440 through the connection member 1431.

The rigid substrate 1440 also supports other electronic component 1441, 1442, and 1443. The electronic components 1441, 1442, and 1443 correspond to the process parts 101-113 shown in FIG. 3.

The second sub-component 1402 of the flexible circuit board 1400 is flexible and arranged in a meandering state in the segment 1180. The third sub-component 1403 of the flexible circuit board 1400 is connected to a battery 1411 which is placed in the segment 1190. The fourth sub-component 1404 of the flexible circuit board 1400 is flexible and arranged in a meandering state at a segment 1200. The fifth sub-component 1405 of the flexible circuit board 1400 is connected to the battery 1421.

Figure 5:
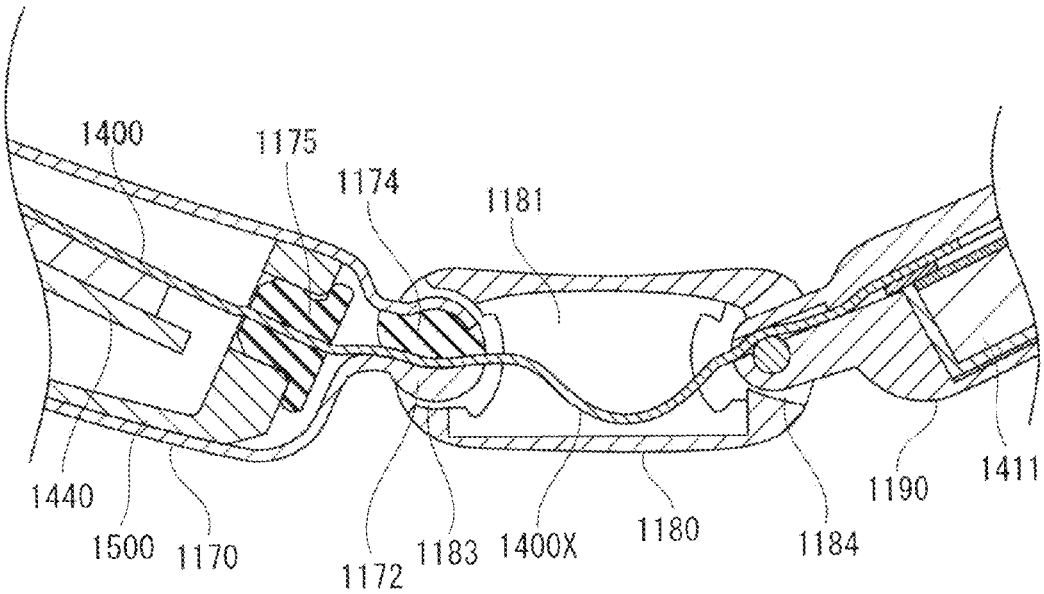
FIG. 5 is a cross-section of the segments of the band type electronic device illustrating the meandering-state detail of the flexible circuit board according to an exemplary embodiment of the present disclosure.

FIG. 5 is a cross-section of the segments 1170-1190 illustrating the meandering-state detail of the flexible circuit board 1400. The flexible circuit board 1400 is continuously arranged inside each segment 1170-1190. The flexible circuit board 1400 passes through the inside of the connector 1172 of a segment 1170, and the connector 1183 of a segment 1180. Inside the connector 1172 includes the waterproof member 1174 through which the flexible circuit board 1400 passes. The waterproof member 1174 prevents the water from entering inside of the segment 1170. In addition another waterproof member 1175 is arranged inside the internal casing 1500 of the segment 1170. Similarly, inside the segment 1180, the waterproof members 1181 and 1182 (refer FIG. 2) are arranged to prevent water permeation inside the segment 1180.

Each of the waterproof members 1174, 1175, 1181 and 1182 can be formed by a waterproof material such as a relatively soft resin. The soft resin also fills up any clearance gap between the inner side of the segment 1180 and the flexible circuit board 1400.

Inside the segment 1180, the flexible circuit board 1400 can be arranged in a meandering-state, i.e., a curved meander location 1400X is formed in the flexible circuit board 1400 inside the segment 1180. The curved meander location 1400X of the flexible circuit board 1400 prevents damage to the flexible circuit board 1400. For example damage may be caused in case of bending, pulling or extension of the flexible circuit board 1400. As such when the connector of the segment 1180 and the segment 1170 bends, meander location 1400X of the flexible circuit board 1400 is extended linearly, and the flexible circuit board 1400 is not stretched. Therefore, the flexible circuit board 1400 may not rupture and can prevent any malfunctioning due to rupture. It should be noted that the meander location 1400X shown in FIG. 5 is not limited to above discussion. Any other meander form and meander location may be possible. For example, the meander location 1400X can be made into various shapes such as a zigzag shape, an S shape, a V shape, a U shape, a Z shape, curve shape, semi-circle shape, and a broken line shape.

Figure 6:
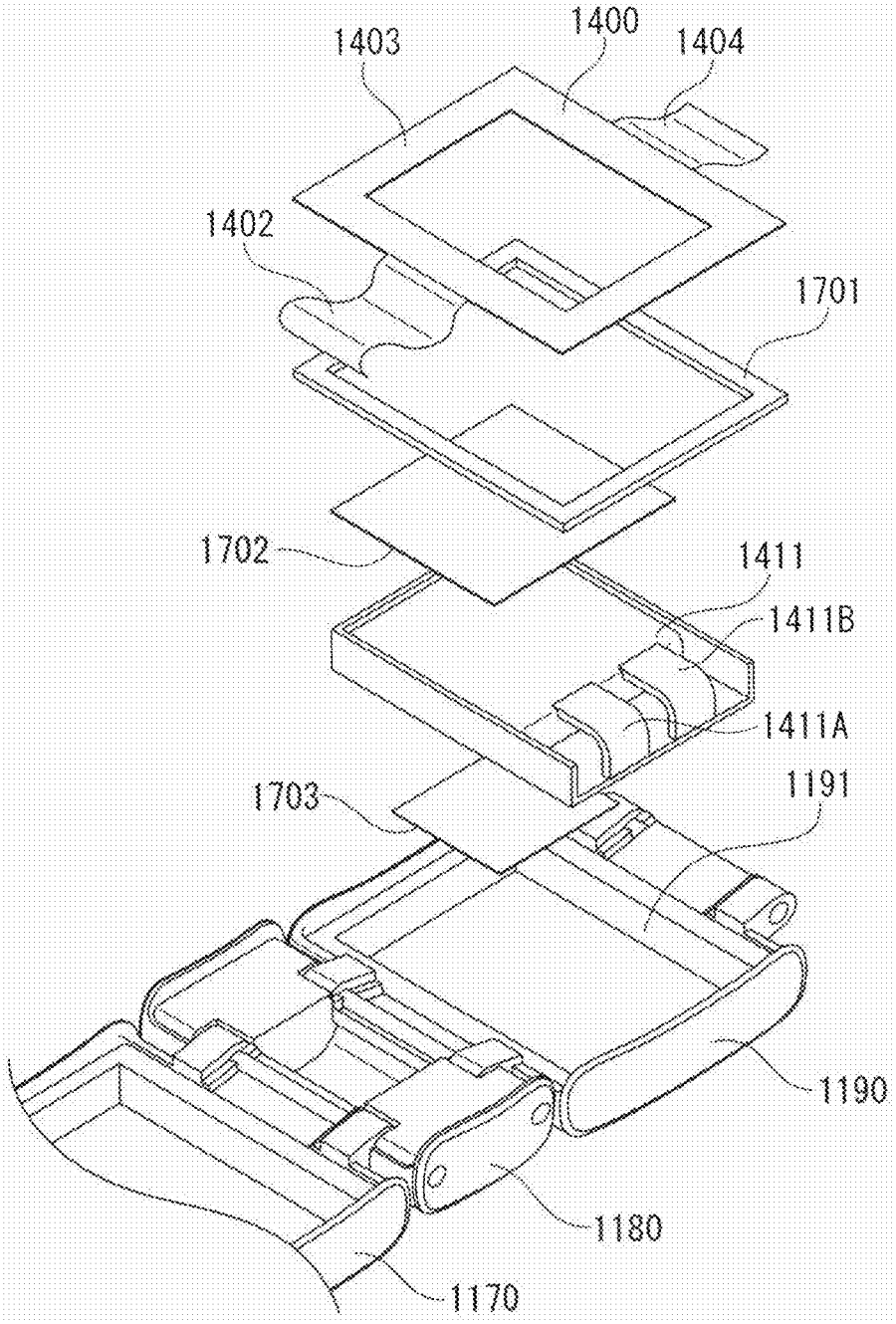
FIG. 6 illustrates a battery assembly in a segment of the band type electronic device according to an exemplary embodiment of the present disclosure.

FIG. 6 illustrates a battery assembly in a segment according to an embodiment of the present disclosure. The battery 1411 is assembled along with some sub-components of the flexible circuit board 1400 and placed inside the segment 1190. A similarly configuration is followed when arranging the battery 1421 in the segment 1210.

The battery 1411 is placed in a battery compartment 1191 inside the segment 1190. On one side of the battery 1411, i.e., between the battery compartment 1191 and bottom side of the battery 1411, a bonding sheet 1703 is placed. On the other side of the battery 1411, i.e., between the flexible circuit board 1400 and the top side of the battery 1411, bonding sheets 1702 and 1701 are placed. As such the third sub-component 1403 of the flexible circuit board 1400 adheres the top surface of the battery 1411 by means of the bonding sheets 1701 and 1702.

The bonding sheet 1701 establishes a connection between electrodes 1411A and 1411B of the battery 1411 and a circuit pattern (not shown) on the flexible circuit board 1400. Furthermore, the surface of a battery 1411 adheres to the cover (not shown) of the segment 1190 through the adhesive sheet 1702. The bonding sheet 1701 has a rim-like structure to cover the surroundings of the surface of a battery 1411. As such the bonding sheet 1701 functions as a waterproof member for the battery 1411 in the segment 1190.

Figure 7:
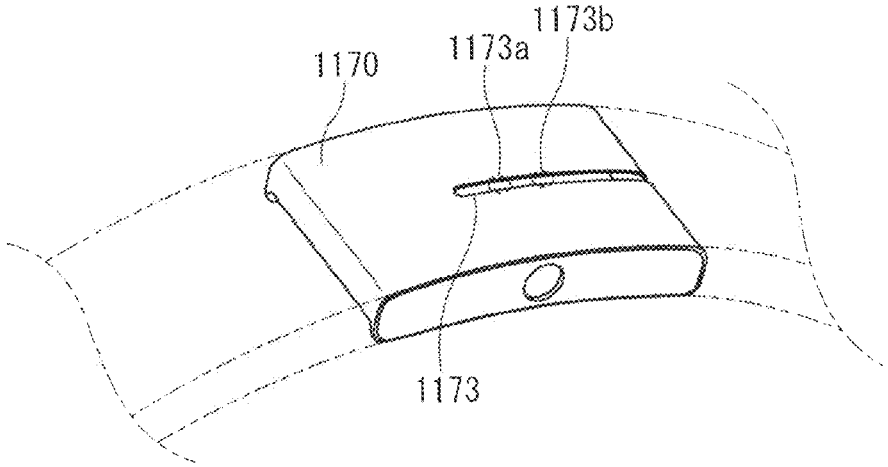
FIG. 7 illustrates a display of a segment of the band type electronic device according to an exemplary embodiment of the present disclosure.

FIG. 7 illustrates a display of a segment of the band type electronic device. In the segment 1170, the display 108, discussed with reference to FIG. 3, may include several light emitting diodes. The light emitting diodes can be arranged in the vicinity of the slit 1173 of the segment 1170. The light emitting diode are placed inside the inner casing 1500 (not shown), which is formed of a transparent or semi-transparent resin. As such, when the light emitting diodes turns on, the light will be visible through the slit 1173, and the user can confirm the lighting. For example, a first location 1173*a* between the slit 1173 may become bright when one of the light emitting diode is switched on. A second location 1173*b* between the slit 1173 may become bright when a different light emitting diode is switched on. In another embodiment, separate colors may be used at each of the locations 1173*a* and 1173*b*. The light may be used for various purposes depending on the function implemented in the processing circuitry. For example the light may indicate a reception of a telephone, or a reception of an email.

Figure 8:
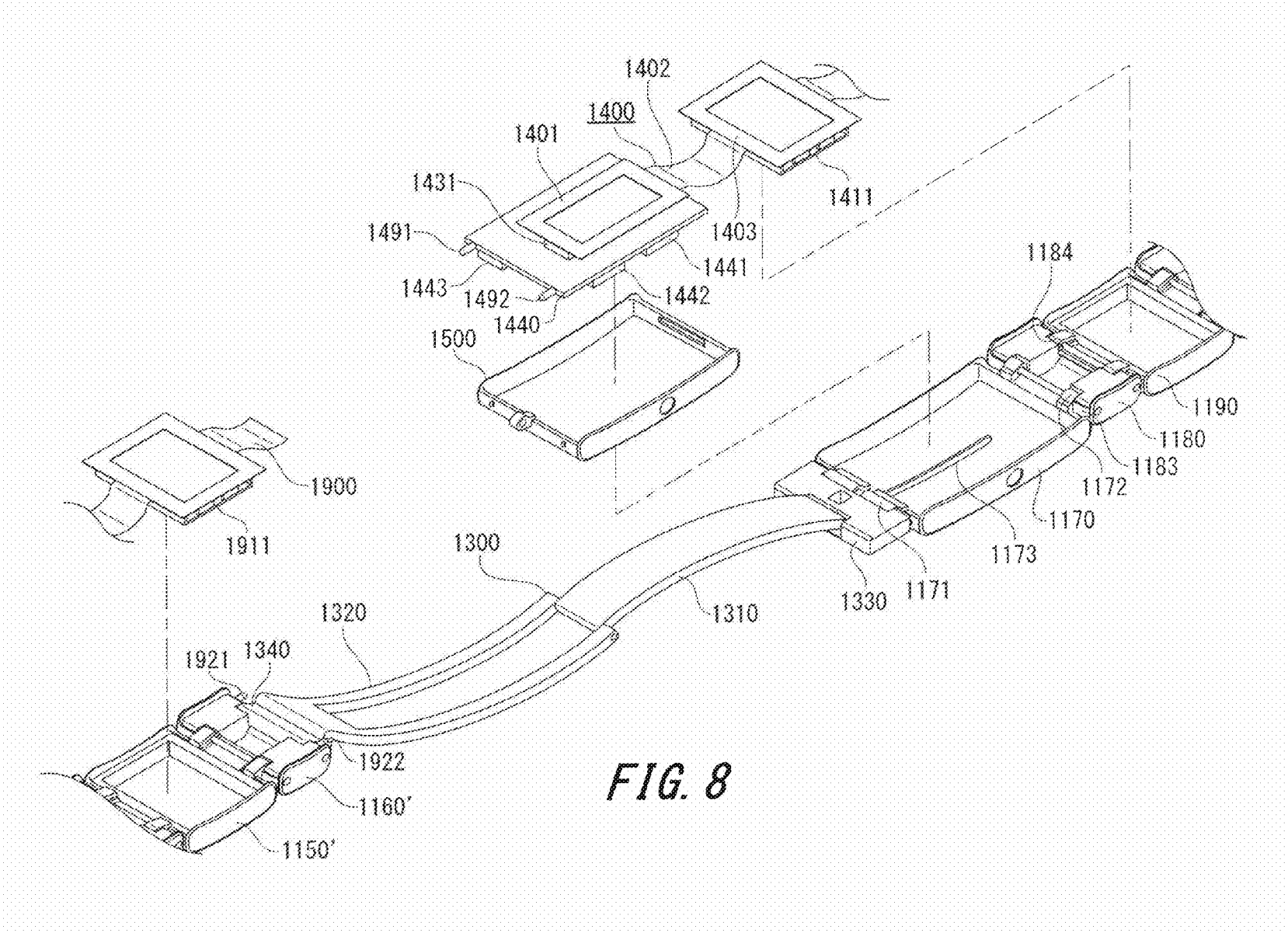
FIG. 8 illustrates extra battery arrangement in a segment of the band type electronic device according to an exemplary embodiment of the present disclosure.

FIG. 8 illustrates extra battery arrangement in the segment. Referring back to FIG. 4 the batteries 1411 and 1412 were arranged in the segment 1190 and 1210 respectively. Alternatively, a battery may be arranged in any other segments of the band type electronic device 1000. For example in FIG. 8, a battery 1911 is placed in the segment 1150' to the segment 1160'. The segment 1160' is further connected to the buckle part 1300. The two segments 1150' and 1160' connected to the buckle part 1300 are equipped with the flexible circuit board 1900. The battery 1911 is attached to the flexible circuit board 1900.

In the segment 1160', a pair of electrically conductive pins 1921 and 1922 are arranged, and the electrically conductive pin 1921 and 1922 are connected to the battery 1911 through the circuit pattern (not shown) in the flexible circuit board 1900.

In segment 1170, a different pair of electrically conductive pins 1491 and 1492 is arranged on the flexible circuit board 1400. The electrically conductive pins 1491 and 1492 protrude from the end of the segment 1170.

When the buckle part is in the locked state, the electrically conductive pins 1491 and 1492 within the segment 1170 comes in contact with the electrically conductive pins 1921 and 1922 within the segment 1160'. As such, a connection is established between the battery 1911 and the flexible circuit board 1400. Alternatively, a connection between the battery 1911 and the flexible circuit board 1400 can be established by installing connecting end pieces, for example, on segment 1170 and on segment 1150' respectively.

The band type electronic device 1000 of the present disclosure provides several advantages. The band type electronic device 1000 can be attached to a conventional watch and can notify user, for instance an incoming email, or an incoming reception; record a log of a user's action history, telephone calls, etc. similarly to a smart watch. As the timepiece body can be a conventional timepiece, the band type electronic device of the present disclosure can be used as a with several watch designs that are available as a fashion accessory.

Furthermore, the band type electronic device 1000 of the present disclosure can be equipped with the function as a noncontact IC card, and can perform the payment and authentication using a noncontact IC card.

The segments of the band type electronic device 1000 include a waterproof structure that can be in a meandered state and in a zigzag pattern. The waterproof structure protects the flexible circuit board 1400 from water as well as prevents from ripping off.

Furthermore, the antenna in the metal segments 1170 are arranged in the vicinity of a slit 1173 of the segment 1170 that avoids interference due to metal casing and helps maintain an uninterrupted transmission and reception.

According to the present disclosure, the wireless communications of Bluetooth was able to do pairing between devices that are approximately 10 m distance apart. The wireless communications was performed the band type electronic device and a smart phone at a 2.4 GHz band communication.

While certain embodiments have been described, these embodiments have been presented by way of example only, and are not intended to limit the scope of the present disclosures. Indeed, the novel methods, apparatuses and systems described herein can be embodied in a variety of other forms; furthermore, various omissions, substitutions and changes in the form of the methods, apparatuses and systems described herein can be made without departing from the spirit of the present disclosures. The accompanying claims and their equivalents are intended to cover such forms or modifications as would fall within the scope and spirit of the present disclosures. For example, this technology may be structured for cloud computing whereby a single function is shared and processed in collaboration among a plurality of apparatuses via a network.

In other embodiments several variations can be made. For example, the segment 1170, 1190 and 1210 which hold the flexible circuit board and the batteries can be comparatively on a larger, while the segments 1180, 1200 which only provide meandering location can be of comparatively smaller size. However, the size of the segments can be approximately same.

With reference to FIG. 3, the voice processing circuitry 111, the microphone 112, and the speaker 113 are arranged in the segment 1170, and can be used to perform a voice call, give voice instructions, etc. However, the band type electronic device may omit the voice processing circuitry 111, the microphone 112, and the speaker 113.

Furthermore all the electronic components other than battery 1411, 1421 were arranged in one segment 1170. However, the electronic components may be distributed into several segments.

The display 108 used the light emitting diode. On the other hand, the display 108 may use a liquid crystal display, an organic electroluminescent panel, etc., and may show a character, a number, a figure, etc.

What is claimed is:

1. A band-type electronic device comprising:

a plurality of segments connected with each other in a band-like shape through connectors, the segments being movable with respect to each other by rotating around respective connectors;

a plurality of electronic components arranged in the plurality of segments; and a flexible circuit board connected to the plurality of electronic components arranged in the segments, wherein the plurality of segments includes a first segment accommodating a buckle part in a closed configuration of the buckle part and accommodating a display element, and the plurality of segments further includes a second segment including the flexible circuit board, the second segment being connected to the first segment, the flexible circuit board of the second segment being connected to a battery included in a third segment, the second segment being smaller than the first segment and the third segment.

2. The band-type electronic device according to claim 1, wherein the plurality of segments is configured to connect a main body of a timepiece.

3. The band-type electronic device according to claim 1, wherein the first segment has at least one of the plurality of electronic components arranged therein, and the flexible circuit board is partly deformed into the meandering shape in the second segment.

4. The band-type electronic device according to claim 1, wherein a connector between the first segment and the second segment includes a waterproof member, wherein the waterproof member is configured to form a first waterproof structure that covers the flexible circuit board.

5. The band-type electronic device according to claim 1, wherein the third segment includes a waterproof structure.

6. The band-type electronic device according to claim 5, wherein the waterproof structure is formed by a plurality of bonding sheets attached to the battery arranged in the third segment and attached to the flexible circuit board.

7. The band-type electronic device according to claim 1, further comprising:

a communication circuitry and a notification circuitry, wherein the communication circuitry sends and receives a wireless communication signal, and the notification circuitry sends a notification signal to a user of the band-type electronic device based on signal received from the communication circuitry.

8. The band-type electronic device according to claim 7, wherein the communication circuitry includes an antenna.

9. The band-type electronic device according to claim 8, wherein the communication circuitry is arranged in the first segment.

10. The band-type electronic device according to claim 9, wherein the first segment is formed of a metal and has a slit formed therein.

11. The band-type electronic device according to claim 10, wherein the antenna of the communication circuitry is placed near the slit of the first segment.

12. A band-type electronic device comprising:

a flexible circuit board;

means for containing the flexible circuit board in a plurality of segments connected to each other in a band-like shape through connectors, the segments being movable with respect to each other by rotating around respective connectors; and means for attaching a plurality of electronic components to the flexible circuit board, wherein the plurality of segments includes a first segment accommodating a buckle part in a closed configuration of the buckle part and accommodating a display element, and the plurality of segments further includes a second segment including the flexible circuit board, the second segment being connected to the first segment, the flexible circuit board of the second segment being connected to a battery included in a third segment, the second segment being smaller than the first segment and the third segment.

13. The band-type electronic device according to claim 12, wherein the plurality of segments includes a first waterproofing means that covers the flexible circuit board.

14. The band-type electronic device according to claim 12, wherein at least one of the plurality of segments includes a means for allowing an antenna to receive and transmit signals with decreased interference.

15. The band-type electronic device according to claim 12, wherein a means for connecting the plurality of segments includes a second waterproofing means that covers the flexible circuit board.

16. A system comprising:

a timepiece; and a band-type electronic device attached to the timepiece, wherein the band-type electronic device comprises:

a plurality of segments connected with each other in a band-like shape through connectors, the segments being movable with respect to each other by rotating around respective connectors;

a plurality of electronic components arranged in the plurality of segments; and a flexible circuit board connected to the plurality of electronic components arranged in the plurality of segments, wherein the plurality of segments includes a first segment accommodating a buckle part in a closed configuration of the buckle part and accommodating a display element, and the plurality of segments further includes a second segment including the flexible circuit board, the second segment being connected to the first segment, the flexible circuit board of the second segment being connected to a battery included in a third segment, the second segment being smaller than the first segment and the third segment.

17. The band-type electronic device according to claim 1, wherein the display element is formed by at least one of a light emitting diode, a liquid crystal display, and an organic electroluminescent panel.

* * * * *